United States Patent [19]

Wolters et al.

[11] 3,961,673

[45] June 8, 1976

[54] DRILLING APPARATUS

[75] Inventors: Jakob Wolters, Wegberg-Beeck; Josef Classen, Heinsberg-Horst, both of Germany

[73] Assignee: Maschinen- und Bohrgerate Fabrik Alfred Writh & Co., K.G., Erkelenz, Germany

[22] Filed: Mar. 24, 1975

[21] Appl. No.: 561,160

[30] Foreign Application Priority Data

Apr. 2, 1974 Germany ..... 11496[U]

[52] U.S. Cl. ..... 175/52; 173/32; 175/9; 175/85; 175/210

[51] Int. Cl.[2] ..... E21B 19/14

[58] Field of Search ..... 175/5, 7, 89, 61, 85, 175/52, 86, 122, 210, 219, 171, 170, 162, 62, 173; 173/32, 33, 34; 61/53, 53.5, 53.6, 46; 182/2

[56] References Cited

UNITED STATES PATENTS

| | | | |
|---|---|---|---|
| 1,243,580 | 10/1917 | Besancon | 175/162 |
| 2,565,777 | 8/1951 | Moon | 182/63 X |
| 2,598,454 | 5/1952 | Smith | 173/43 X |
| 2,606,078 | 8/1952 | Brock | 182/2 X |
| 3,495,667 | 2/1970 | Cales | 175/85 X |
| 3,539,024 | 11/1970 | Irons et al. | 175/9 X |
| 3,825,076 | 7/1974 | Kolb | 175/5 |
| 3,857,451 | 12/1974 | Williams | 173/32 X |

*Primary Examiner*—Ernest R. Purser
*Assistant Examiner*—Richard E. Favreau
*Attorney, Agent, or Firm*—Holman & Stern

[57] ABSTRACT

A drill string is mounted on a mast which is angularly adjustable relative to a frame. A support is connected to the frame so as to be angularly adjustable and has an open aperture for the drill string. The support is to be mounted on and secured upon a stationary member, such as a pipe, disposed at the operating location of the drilling apparatus.

9 Claims, 3 Drawing Figures

DRILLING APPARATUS

FIELD OF THE INVENTION

The invention relates to drilling apparatus, more particularly for sinking pile boreholes or the like, having a frame, a mast which is adjustable or inclinable at an angle about a pivoting axis relative to the frame, and a rotatingly driven drill string.

BACKGROUND OF THE INVENTION

Known drilling apparatus of this kind is provided with a substructure or a supporting construction for all applications in which it is impossible or undesirable for the frame to be merely placed on the ground. To sink boreholes into the bottom of oceans, lakes, rivers, and the like the drilling apparatus is mounted on a drilling platform or is retained by a lattice frame which, in turn, is mounted on a rise-and-fall platform. Systems of this kind call for a corresponding amount of space and can frequently be produced and accommodated only with special effort.

Particular problems may arise in drilling boreholes which extend at an angle, i.e. at a greater or lesser angle with respect to the vertical, because it may be necessary for a plurality of adjusting motions to be carried out in different directions and these, in turn, will necessitate displacement of the apparatus or its substructure.

It is an object of the invention to overcome existing difficulties and imperfections and to produce a simple drilling apparatus for applications in which a stationary element suitable for absorbing loadings is available or can be prepared on or at the region of the borehole, such with drilling apparatus requiring no separate supporting structure or the like and being therefore dependent, in this sense, of auxiliary apparatus but nevertheless being adjustable simply and easily and being adaptable to the appropriate application, more particularly for inclined boreholes. It is a further object of the invention to construct drilling apparatus of the kind described hereinbefore, in its entirety and in its parts, but in a particularly suitable manner.

SUMMARY OF THE INVENTION

According to the invention, the drilling apparatus includes a support which is connected to the frame aperture for the drill string, said support being adapted for mounting on and being secured upon a stationary member, more particularly a pipe or pipe-like element adapted to admit the drill string and being disposed at the operating location of the drilling apparatus. To this end, the frame of the drilling apparatus can be constructed as a working platform or can be provided with such a platform and may also support a control stand and other units required for operation of the apparatus.

Drilling apparatus of this kind represents a compact unit which can be handled in its entirety without excessive difficulties and can be placed and secured rapidly on a pipe, for example a stand pipe, shroud pipe, shuttering pipe, or the like, as used for many kinds of drilling operations, and sunk into the soil or rock by ramming, vibrating, or in some other manner. The drilling operation can then be performed in the desired manner. This applies more particularly to inclined bores, for example in the production of bored piles. The apparatus can then be rapidly adjusted to the specified angle, the axis of the opening of the support being in flush alignment with the axis of the pipe or the like and therefore also with the axis of the borehole, while the frame of the working platform has a horizontal position and the mast is inclined through the appropriate angle and is orientated parallel to the axis of the borehole. This is possible in an uncomplicated manner and without any extensive resetting operations, thus permitting simple adaptation to different or changing operating conditions.

In order to obtain adjustability of the support, one suitable embodiment is inter alia constructed so that the support is pivotable relative to the frame about an axis which extends parallel to the pivoting axis of the mast. A particularly advantageous embodiment is constructed so that the support is pivotable relative to the frame about an axis which extends coaxially with the pivoting axis of the mast or coincides therewith.

Drilling apparatus of the kind described above is frequently provided with hydraulically operating elements so that a hydraulic supply unit is also available. In this case, it is particularly advantageous if at least one pressure-medium-actuated piston-cylinder unit is provided for the angular adjustment of the support relative to the frame. A piston-cylinder unit of this kind is suitable on the one hand for effecting the sensitive adjustment of support and frame relative to each other and on the other hand for reliably retaining the two parts after adjustment in the selected position. Other means for the interrelated positioning of the support and frame are not excluded.

Advantageously, the support is provided with clamping means for detachably securing it on a pipe or the like. The operation of mounting the apparatus and releasing it after the completed drilling operation can be rapidly performed by these means.

In particular, the clamping device may be provided with one or more clamping saddles which surround the support and can be hydraulically or mechanically clamped or released.

In one simple and suitable embodiment, the support, at least the bottom part thereof, is shaped as a pipe. If clamping devices are employed to secure the support, at least part of the length thereof can be provided with at least one slot. This provides improved deformability for the mounting operation.

Retaining means for the drill string can be advantageously mounted on the support.

If the drilling apparatus is provided with a rotary power driving head which is pivotably supported on a slide or the like that is adjustable along the longitudinal extension of the mast, one advantageous embodiment according to the invention is constructed so that a retaining means for drill string components (e.g. drill rods) is situated in the zone of inclination of the mast so that drill string components can be removed from and returned to the retaining means by means of the rotary power driving head.

According to a further feature of the invention, in a drilling device with means for applying for pressure to the drill string and with a carriage adapted to support the rotary power driving head and being adjustable along the longitudinal extension of the mast; the carriage can be slid along a guide by means of a pressure-medium-actuated device, more particularly at least one piston-cylinder unit, with the guide itself being longitudinally adjustable on the mast and being lockable thereon at different heights.

The invention is not confined to the use of a rotary power driving head but the drilling apparatus may also have other means for driving the drill string. More particularly, it is also possible to provide a turntable on the support.

DESCRIPTION OF THE DRAWINGS

Further details and features of the invention are explained hereinbelow by reference to the accompanying drawings, in which.

DESCRIPTION OF A PREFERRED EMBODIMENT

Figure 1:
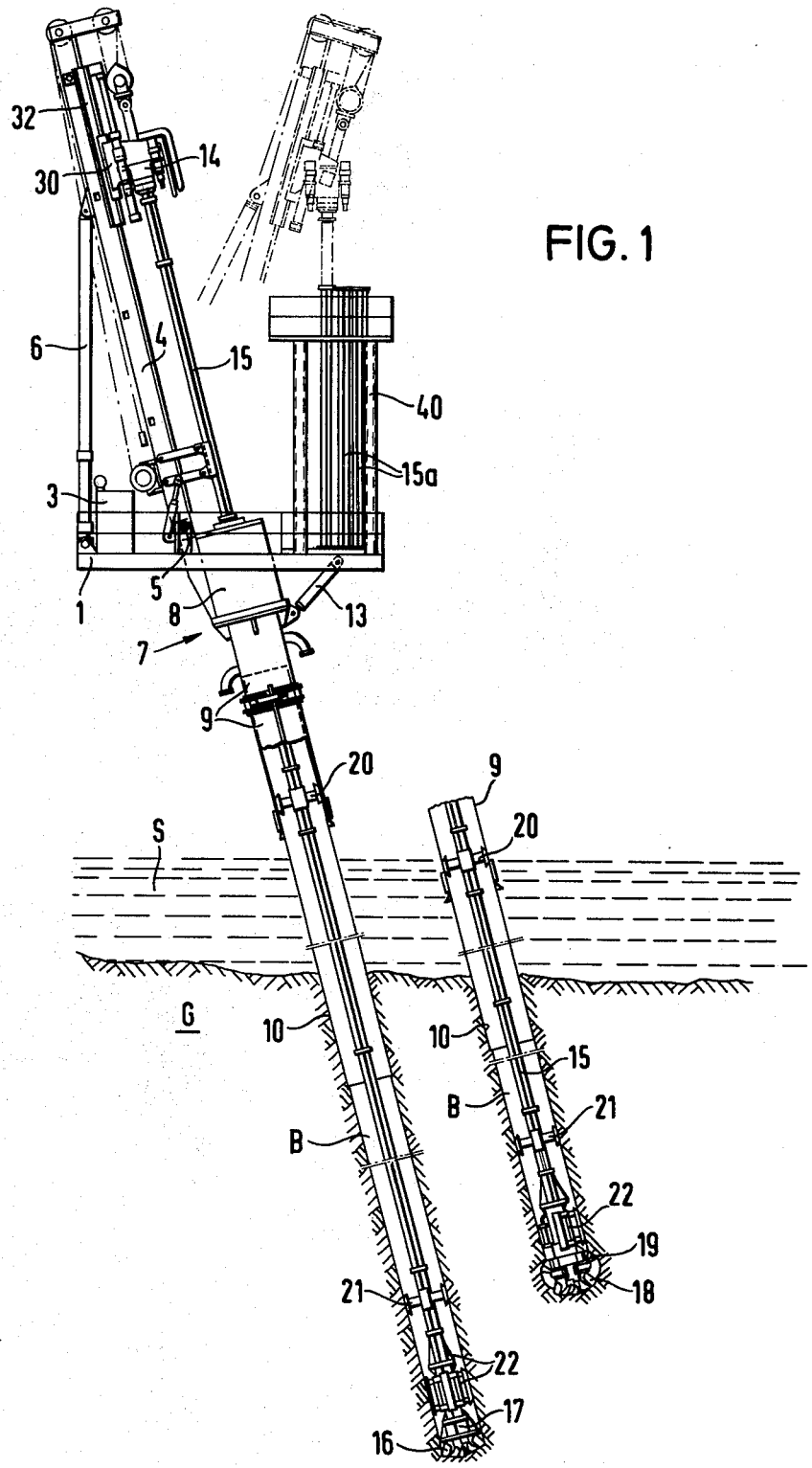
FIG. 1 shows a drilling apparatus according to the invention in operation.

The illustrated drilling apparatus comprises a frame structure 1 which is also constructed as an operating platform with railings 2 and supports a control stand 3 and the other devices which are not shown in detail but are required for operation. A mast 4, for example constructed of steel sections, is retained near its bottom end by a pivoting shaft 5 which is supported in pedestals 1*a* or the like of the frame 1 and can be set to an angle relative to the frame 1 by lengthening or shortening of a support member 6, for example from the position shown in the illustration in solid lines to the position shown in dash-dot lines and vice versa. A double-acting hydraulic piston-cylinder unit, one end 6*a* of which is hinged to the frame 1 and the other end 6*b* of which is hinged to a higher position of the mast 4, constitutes the variable-length support member 6 in the illustrated embodiment.

The drilling apparatus is also provided with a support 7 comprising a top part 8 extending through the frame and a bottom part 9 constructed as a pipe member (shown broken away in the bottom zone) for placing on a stand pipe 10 which is rammed into a bottom G of a water area S (FIG. 1) in which a borehole is to be drilled. The bottom end 9*a* of the pipe member is flared to facilitate placement on the stand pipe 10. The part 9 of the support functioning as pipe mounting member is provided with a longitudinal slot 9*b* and with a clamping device to permit detachable securing on the pipe 10. The clamping device contains two clamping saddles 11 each being adapted for opening and closing by means of a hydraulic cylinder unit 12. The interior of the pipe member 9 can be provided with a shoulder or the like against which the top end of the stationary pipe 10 bears when the drilling apparatus is placed on the pipe, an operation which can be performed by means of a crane or some other suitable device.

The top part 8 of the support 7 is provided with two extensions 8*a* which, in the illustrated embodiment, are supported on the same pivoting shaft 5 which also mounts the mast 4 in an angularly adjustable position. At least one hydraulically operated double-acting piston-cylinder unit 13 is provided between the support 7 and the frame 1 in such a way that the support 7 can be moved about the pivoting shaft 5 relative to the frame 1 to enable the angular position to be adjusted.

The drilling apparatus described above represents a compact unit without any separate support structure and incorporates the adjusting facilities which are desired for adaptation to appropriate conditions. For example, if the frame 1 remains in the horizontal position, the support 7 can be adapted by means of the hydraulic cylinder unit 13 to the angle of inclination of a borehole B (FIG. 1) which is to be drilled. This also applies to the mast 4 of the apparatus. Rapid resetting to a different angle of inclination of the borehole or setting to a vertical borehole is, therefore, also possible.

A drill string 15, connected at the top to a rotary power driving head 14, extends through an adequately sized opening (not shown) of the support 7 and through the stand pipe 10 and the bottom end is provided with a suitable drilling tool, for example with a cutter member 17 having roller bits 16 (in the left-hand bottom part of FIG. 1) or a drill bit 18 with undercutter and enlarging bit 19 (as shown in the right-hand bottom part of FIG 1). The drill string can be provided with intermediate pieces and stabilizers 20 for the stand pipe 10, with intermediate pieces and stabilizers 21 for the borehole B and with stabilizers 22 disposed on the drilling tool. A guide sleeve or centering device 23 is operated by means of a hydraulic cylinder unit 24 for centering the drill string. A retaining or interceptor device 25 is advantageously mounted on the top part 8 of the support 7. Such a device is shown at 49 in FIGS. 9–14 of my U.S. Pat. No. 3,741,322 issued June 26, 1973.

The rotary power driving head 14 which, together with the drill string 15, is retained by a block and tackle 29 and a rope 28 extending from a winch 27 and running over sheaves in a mast head 27, is disposed on a carriage 30 in which it is supported so as to be pivotable about a horizontal axis 31; hydraulic actuating means can be provided for performing the optional pivoting motion. The rotary power driving head carriage 30 can be directly guided on the mast; in the illustrated embodiment, however, it is slidable on a guide carriage 32 which, in turn, is longitudinally adjustable on the mast 4 and can be secured thereon at different heights. Securing can be effected, for example, by locking means 33 which are provided on each side of the guide carriage 32 with a pawl, or the like, adapted for remote operation and for engagement into one of a plurality of openings 34 which are provided along the mast 4. The guide carriage 32 can be longitudinally adjusted by means of the previously-mentioned rope 28 and block and tackle 29 when the locking means are released.

The rotary power driving head carriage 30 is adjustable on the guide carriage 32 by means of at least one piston-cylinder unit 35 in such a way that a thrust corresponding to the magnitude of the selected hydraulic pressure can be applied to the rotary power driving head carriage 30 and, therefore, on the drill string 15 via the rotary power driving head 14 when the guide carriage 32 is locked.

The drilling apparatus according to the invention can be arranged so that it can be used for drilling processes of different kinds, more particularly in the air lift drilling method. To this end, the rotary power driving head 14 can be provided with an air lift insert 14*a*. A numeral 36 refers to a hose for supplying compressed air and numeral 37 refers to the discharge hose for the flushing fluid which is loaded with drilling debris. The support 7 or its bottom part 9 is provided with an inlet 38 and, where appropriate with an overflow 39 to enable the stand pipe 10 or the borehole to be filled with a flushing fluid.

A magazine 40 for drill string components 15*a* (drill rods) is disposed on the frame 1 in the zone of inclination of the mast 4 so that the drill string components 15*a* can be removed from the magazine 40 and can be returned thereto by means of the rotary power driving head 14 if the mast 4 is appropriately inclined.

In particular, the drill rod magazine 40 is constructed and detachably mounted on the frame 1 so as to be interchangeable. A full drill rod magazine can then be exchanged for an empty one, for example when drilling boreholes of substantial depth.

The drilling apparatus may be provided with a turntable in place of a rotary power driving head, with the turntable being then advantageously disposed on the support.

Figure 3:
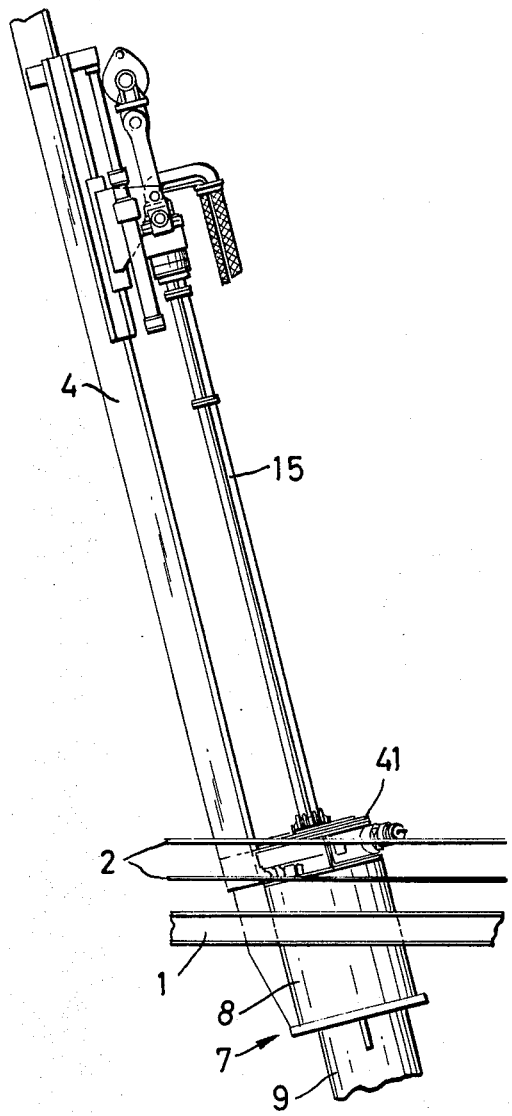
FIG. 3 shows a drilling apparatus according to the invention provided with a turntable.

In FIG. 3 is illustrated an embodiment of the drilling apparatus in which a turntable 41 is mounted on the top part 8 of the support 7. The turntable 41 may be of conventional construction and, as usual, is provided with an inner rotatable portion and an outer stationary portion. The rotatable portion of the turntable through which, in a known manner, the upper part of the drill string passes, can be driven by a hydraulic motor.

Figure 2:
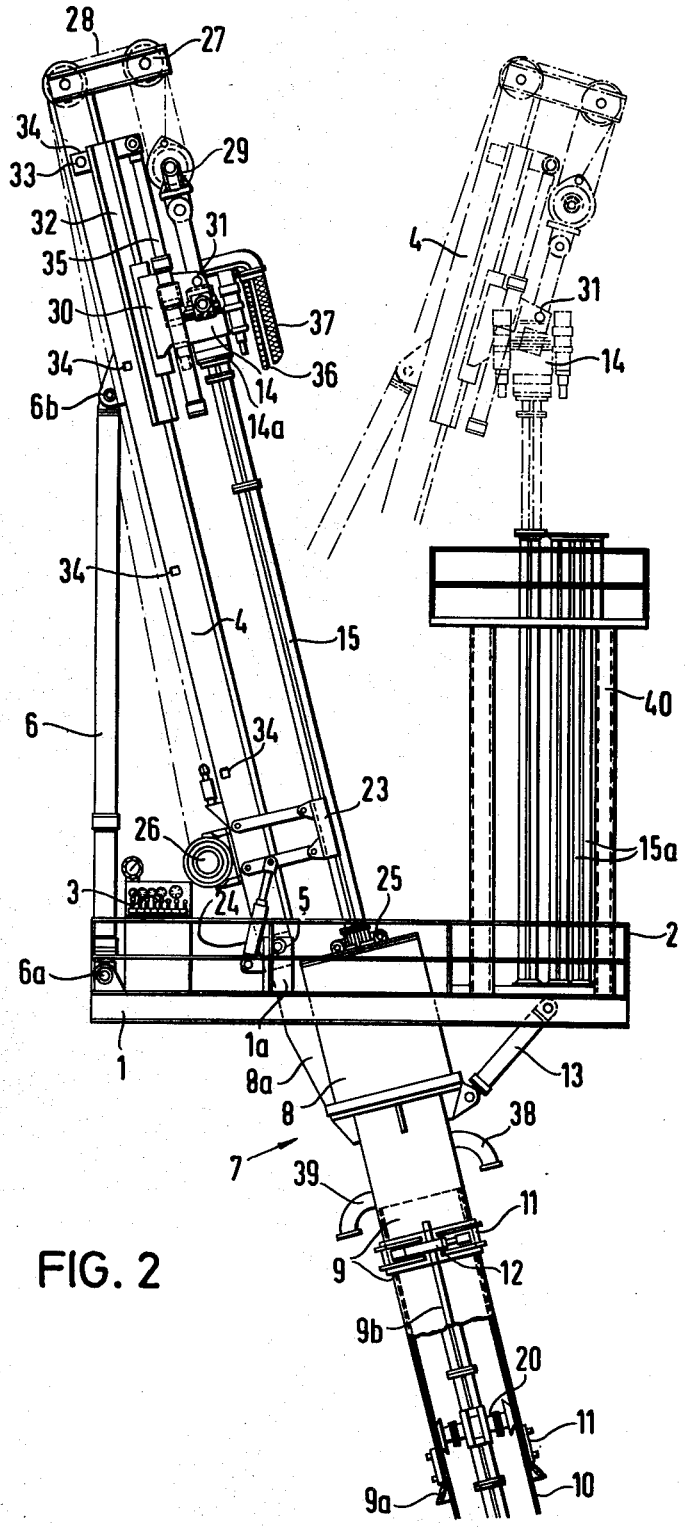
FIG. 2 shows the drilling apparatus according to FIG. 1 to an enlarged scale.

The parts of this embodiment which correspond to those in FIG. 2 bear the same reference numerals.

The drilling apparatus according to the invention generally permits much more rapid operation than with devices known hitherto. Seasonal weather effects also no longer play an important part because of the simplified handling of the entire device. The novel construction and equipment of the apparatus also provides cost savings. Inter alia, the costs for lifting platforms, drilling vessels, crane installations, and the like can be lowered. The large weight of drill collars otherwise required is also eliminated. General wage costs are reduced owing to the simplified operation and handling of lower weights. This applies particularly to the use of apparatus for sinking boreholes into the bottom of rivers, lakes, oceans, and the like where wage costs are not comparable with those obtaining in conventional land use.

We claim:

1. A drilling apparatus comprising a frame structure, a mast, a pivoting axis and a support means having an adjustable length operably related to the frame structure and mast for connecting the mast to the frame structure, the mast being angularly adjustable relative to the frame structure about the pivoting axis by adjusting the length of the support means, a drill string extending along the mast, drive means for rotating the drill string, a support having an opening for the passage of the drill string, the support being pivotally connected to the frame structure, adjustable connecting means between the support and frame structure by which the support is angularly adjustable relative to the frame structure by adjusting the length of the connecting means, the support having a lower part defined by a tube-like member for mounting on the upper end of a stationary pipe,

2. The drilling apparatus as claimed in claim 1, in which said support means having an adjustable length and said connecting means are each constituted by a pressure-medium-actuated piston-cylinder unit.

3. The drilling apparatus as claimed in claim 1, in which the support is pivotable relative to the frame structure about the pivoting axis of the mast.

4. The drilling apparatus as claimed in claim 1, in which the support includes a clamping device for detachably securing the support upon said stationary pipe.

5. The drilling apparatus as claimed in claim 1, comprising means for applying pressure to the drill string, said drive means for rotating the drill string being constituted by a rotary power driving head, a guiding and supporting member longitudinally adjustable on the mast and fixable therein in adjusted positions, a power driving head carriage adapted to be moved relatively to and along the guiding and supporting member and a pressure-medium-operated device for moving the carriage, the power driving head being supported on the carriage.

6. The drilling apparatus as claimed in claim 1, in which said drive means for rotating the drill string is constituted by a turntable mounted on said support and through which the drill string passes.

7. The drilling apparatus as claimed in claim 1, in which said drive means for rotating the drill string is constituted by a rotary power driving head, a power driving head carriage adapted to slide longitudinally of the mast on which said driving head is pivotally supported, and a magazine for drill string components situated on the frame structure in the range of inclination of the mast, whereby the drill string components can be removed from and returned to the magazine by means of the rotary power driving head.

8. The drilling apparatus as claimed in claim 7, in which the magazine is interchangeably disposed.

9. In a drilling installation, a drilling apparatus and a stationary pipe disposed at the operating location of the drilling apparatus, the apparatus comprising: a frame structure, a mast, a pivoting axis and a support means having an adjustable length operably related to the frame structure and mast for connecting the mast to the frame structure, the mast being angularly adjustable relative to the frame structure about the pivoting axis by adjusting the length of the support means, a drill string extending along the mast, drive means for rotating the drill string, a support having an opening for the passage of the drill string, the support being pivotally connected to the frame structure, adjustable connecting means between the support and frame structure by which the support is angularly adjustable relative to the frame structure by adjusting the length of the connecting means, the support having a lower part defined by a tube-like member, and a stationary pipe having an upper end, the pipe projecting from a surface at the operating location of the drilling apparatus and through which the drill string passes, the lower part of the support enclosing the upper end of the stationary pipe and being supported and mounted thereon.

* * * * *

UNITED STATES PATENT AND TRADEMARK OFFICE

CERTIFICATE OF CORRECTION

PATENT NO. : 3,961,673

DATED : June 8, 1976

INVENTOR(S) : Jakob Wolters, et al

It is certified that error appears in the above-identified patent and that said Letters Patent are hereby corrected as shown below:

[73] Assignment:
Maschinen-und Bohrgerate-Fabrik Alfred Wirth & Co.K.G.

Signed and Sealed this

Thirty-first Day of August 1976

[SEAL]

*Attest:*

RUTH C. MASON
*Attesting Officer*

C. MARSHALL DANN
*Commissioner of Patents and Trademarks*